US012504013B2

(12) United States Patent
Zhu

(10) Patent No.: US 12,504,013 B2
(45) Date of Patent: Dec. 23, 2025

(54) FLOATING-TYPE OIL-FREE VACUUM SCROLL COMPRESSOR

(71) Applicant: SHENYANG CANTA MEDICAL TECH. CO., LTD., Shenyang (CN)

(72) Inventor: Xiaobo Zhu, Shenyang (CN)

(73) Assignee: SHENYANG CANTA MEDICAL TECH. CO., LTD., Shenyang (CN)

( * ) Notice: Subject to any disclaimer, the term of this patent is extended or adjusted under 35 U.S.C. 154(b) by 0 days.

(21) Appl. No.: 19/018,214

(22) Filed: Jan. 13, 2025

(65) Prior Publication Data

US 2025/0146487 A1 May 8, 2025

Related U.S. Application Data

(63) Continuation of application No. PCT/CN2024/107745, filed on Jul. 26, 2024.

(30) Foreign Application Priority Data

Aug. 30, 2023 (CN) ..... 202311102103.4

(51) Int. Cl.
*F04C 18/02* (2006.01)
*F04C 29/04* (2006.01)

(52) U.S. Cl.
CPC ..... *F04C 18/0215* (2013.01); *F04C 29/04* (2013.01)

(58) Field of Classification Search
CPC ..... F04C 18/14; F04C 18/16; F04C 2240/40; F04C 29/0007; F04C 29/02; F04C 29/025;

(Continued)

(56) References Cited

U.S. PATENT DOCUMENTS 6,758,659 B2 * 7/2004 Ni ..... F04C 29/0057 418/60
11,047,389 B2 * 6/2021 Shaffer ..... F04C 29/0085

(Continued)

FOREIGN PATENT DOCUMENTS

CN 104088786 A 10/2014
CN 207647770 U 7/2018

(Continued)

OTHER PUBLICATIONS

First Office Action in Corresponding Chinese Application No. 202311102103.4, dated Oct. 8, 2023; 13 pgs.

(Continued)

*Primary Examiner* — Jesse S Bogue
(74) *Attorney, Agent, or Firm* — HAUPTMAN HAM, LLP

(57) ABSTRACT

The present disclosure discloses a floating-type oil-free vacuum scroll compressor, including a motor body, a compression end, a vacuum end and a joint. The compression end and the vacuum end are assembled at two ends of the motor body respectively. In the present disclosure, two groups of kinetic plates and fixed plates are arranged on two sides of the motor body respectively, an air volume of air vacuumizing and compression is improved under the same volume, multistage sealing is also formed, a service life of a whole machine is prolonged, working efficiency is improved, kinetic plates, fixed plates and the floating wear-resisting rings are made of a material of PEEK mixed carbon fiber powder and polytetrafluoroethylene, the kinetic plates can be made to be in a micro planar sealing state during a running process, and a characteristic of self-lubricating is achieved.

7 Claims, 14 Drawing Sheets

(58) Field of Classification Search
CPC ..... F04C 29/04; F04C 29/045; F04D 29/58; H02K 5/20
See application file for complete search history.

(56) References Cited

U.S. PATENT DOCUMENTS

| | | | | |
|---|---|---|---|---|
| 2007/0172373 | A1* | 7/2007 | Ni | F01C 17/06 418/55.6 |
| 2014/0356207 | A1* | 12/2014 | Yang | F04C 18/0207 418/55.3 |
| 2019/0360486 | A1* | 11/2019 | Hirata | F04C 18/023 |
| 2025/0122877 | A1* | 4/2025 | Swerts | F04C 29/045 |

FOREIGN PATENT DOCUMENTS

| | | | |
|---|---|---|---|
| CN | 112963345 | A | 6/2021 |
| CN | 115539382 | A | 12/2022 |
| CN | 116378928 | A | 7/2023 |
| CN | 116816669 | A | 9/2023 |
| JP | H09264272 | A | 10/1997 |
| JP | 2023091399 | A | 6/2023 |

OTHER PUBLICATIONS

First Search Report in Corresponding Chinese Application No. 202311102103.4, dated Sep. 27, 2023; 3 pgs.
International Search Report and Written Opinion in Corresponding International Application No. PCT/CN2024/107745, mailed Sep. 21, 2024; 15 pgs.

* cited by examiner

FLOATING-TYPE OIL-FREE VACUUM SCROLL COMPRESSOR

RELATED APPLICATIONS

The present application is a Continuation of International Application No. PCT/CN2024/107745, filed Jul. 26, 2024, which claims priority from Chinese Patent Application No. 202311102103.4, filed Aug. 30, 2023, the disclosures of which are hereby incorporated by reference herein in their entireties.

TECHNICAL FIELD

The present disclosure belongs to the technical field of compressors and particularly provides a floating-type oil-free vacuum scroll compressor.

BACKGROUND OF THE INVENTION

As for a scroll compressor, a scroll is formed by matching a fixed plate and a kinetic plate in the prior art, due to a limit of characteristics of a scroll structure, during assembling, a metal material is usually selected as a meshing material, corresponding scroll matching needs to be performed, a polytetrafluoroethylene sealing strip is usually used for sealing a contact surface of the kinetic plate and the fixed plate, but effective compression cannot be formed after the sealing element is minorly worn.

A positioning mounting method is used in the prior art, the fixed plate and the kinetic plate have to meet an assembling requirement for a specified gap, so as to guarantee sealing of the meshing process, but a yield is extremely low due to extremely high assembling difficulty.

Besides, only one group of fixed plate and kinetic plate is set in an existing scroll compressor in general, which may limit efficiency of air compressing.

SUMMARY OF THE INVENTION

For solving the above problem, the present disclosure provides a floating-type oil-free vacuum scroll compressor.

For achieving the above objective, a technical solution adopted by the present disclosure is that a floating-type oil-free vacuum scroll compressor includes a motor body, a compression end, a vacuum end and a joint, and the compression end and the vacuum end are assembled at two ends of the motor body respectively.

The compression end includes a first compression scroll fixed plate, a second compression scroll fixed plate, a first compression scroll kinetic plate and a second compression scroll kinetic plate, the first compression scroll kinetic plate and the second compression scroll kinetic plate are located inside the first compression scroll fixed plate and the second compression scroll fixed plate, and the first compression scroll kinetic plate and the second compression scroll kinetic plate are assembled at an output end of one side of the motor body.

The vacuum end includes a first vacuum scroll fixed plate, a second vacuum scroll fixed plate, a first vacuum scroll kinetic plate and a second vacuum scroll kinetic plate, the first vacuum scroll kinetic plate and the second vacuum scroll kinetic plate are located inside the first vacuum scroll fixed plate and the second vacuum scroll fixed plate, and the first vacuum scroll kinetic plate and the second vacuum scroll kinetic plate are assembled at an output end of the other side of the motor body.

Floating wear-resisting rings are assembled between the first compression scroll kinetic plate and the second compression scroll kinetic plate and between the first vacuum scroll kinetic plate and the second vacuum scroll kinetic plate, and circular springs are assembled inside the floating wear-resisting rings.

A square shaft which is arranged eccentrically is integrally formed at the output ends of the two sides of the motor body, an outer wall of the square shaft is sleeved with shaft eccentric inner rings, alignment bearings are assembled on outer walls of the shaft eccentric inner rings, the two alignment bearings are respectively assembled inside inner holes of the first compression scroll kinetic plate and the second compression scroll kinetic plate and inside inner holes of the first vacuum scroll kinetic plate and the second vacuum scroll kinetic plate.

The first compression scroll fixed plate, the second compression scroll fixed plate, the first compression scroll kinetic plate, the second compression scroll kinetic plate, the first vacuum scroll fixed plate, the second vacuum scroll fixed plate, the first vacuum scroll kinetic plate and the second vacuum scroll kinetic plate are made of a material of a mixture of PEEK mixed carbon fiber powder and polytetrafluoroethylene, and the floating wear-resisting rings are made of a flexible material of a mixture of PEEK and polytetrafluoroethylene.

Further, volumes of the first vacuum scroll kinetic plate and the second vacuum scroll kinetic plate are greater than volumes of the first compression scroll kinetic plate and the second compression scroll kinetic plate.

Further, a compression end eccentric group is assembled between the first compression scroll fixed plate and the second compression scroll fixed plate, the compression end eccentric group includes an eccentric pin, four rotor eccentric wheels and four floating bearings, the four floating bearings are assembled on outer walls of the rotor eccentric wheels, the four rotor eccentric wheels are connected to an outer wall of the eccentric pin a sleeving mode, the two floating bearings on an outer side are assembled on outer sides of inner walls of the first compression scroll fixed plate and the second compression scroll fixed plate respectively, the two floating bearings on an inner side are assembled on outer sides of side walls of the first compression scroll kinetic plate and the second compression scroll kinetic plate respectively, and an eccentric gap of the eccentric pin is the same as an eccentric gap of the square shaft.

A vacuum end eccentric group is assembled between the first vacuum scroll fixed plate and the second vacuum scroll fixed plate, and a structure and an assembling manner of the vacuum end eccentric group are the same as a structure and an assembling manner of the compression end eccentric group.

Further, a first compression scroll fixed plate scroll plate reserved drainage opening and a second compression scroll fixed plate scroll plate reserved drainage opening which communicate with outermost ends of the scroll plates are formed symmetrically in inner walls of the first compression scroll fixed plate and the second compression scroll fixed plate, an air inlet and an air outlet are formed in an outer wall of the first compression scroll fixed plate, the air inlet is located in a middle of the first compression scroll fixed plate, the air outlet is located on a side of the first compression scroll fixed plate, and the air outlet communicates with an outer end of the scroll plate of the first compression scroll fixed plate.

Structures of the first vacuum scroll fixed plate and the second vacuum scroll fixed plate are the same as structures of the first compression scroll fixed plate and the second compression scroll fixed plate.

Further, compression scroll kinetic plate vent holes are formed in inner sides of surfaces of the first compression scroll kinetic plate and the second compression scroll kinetic plate, the plurality of compression scroll kinetic plate vent holes have the same diameter and are distributed annularly, and compression scroll kinetic plate floating wear-resisting ring mounting grooves are formed in an inner wall of the second compression scroll kinetic plate.

Further, vacuum scroll kinetic plate vent holes are formed in inner sides of surfaces of the first vacuum scroll kinetic plate and the second vacuum scroll kinetic plate, diameters of the plurality of vacuum scroll kinetic plate vent holes which are distributed annularly are reduced in sequence, and vacuum scroll kinetic plate floating wear-resisting ring mounting grooves are formed in an inner wall of the second vacuum scroll kinetic plate.

Further, seal grooves are formed in peripheries of inner walls of the second compression scroll fixed plate and the second vacuum scroll fixed plate, and seal rings are assembled in the seal grooves.

Further, heat dissipation shells are integrally formed in two ends of the motor body, heat dissipation holes are formed in side walls of the heat dissipation shells, heat-conducting counterweight wheels located inside the heat dissipation shells are fixedly mounted on an outer wall of an output end of the motor body, and the second compression scroll fixed plate and the second vacuum scroll fixed plate are fixedly mounted on outer ends of the heat dissipation shells respectively.

Beneficial effects by using the present disclosure are:

1, in the present disclosure, two groups of kinetic plates and fixed plates are arranged on two sides of the motor body respectively, an air volume of air vacuumizing and compression is improved under the equivalent volume, multistage sealing is also formed, a service life of a whole machine is prolonged, the working efficiency is improved, meanwhile, uniqueness matching of the kinetic plates and the fixed plates does not need to be performed by using this structural form, and components are universal.

2, The kinetic plates, the fixed plates and the floating wear-resisting rings are made of the material of PPEK mixed carbon fiber powder and polytetrafluoroethylene, the kinetic plates can be made to be in a micro planar sealing state during a running process, a characteristic of self-lubricating is achieved, the kinetic plates are allowed to have a certain gap range, so as to improve an assembling yield and reduce assembling requirement and difficulty, this characteristic reduces a friction coefficient between the fixed plates and the kinetic plates effectively, a minimum frictional loss after long-time running is achieved, and the whole service life is prolonged.

3, The floating wear-resisting rings are located between the two adjacent kinetic plates and play a role in limiting a position, due to running wear, the squeezed and deformed circular springs initially mounted in the floating wear-resisting rings may gradually change from an ellipse into a circle, so as to support the floating wear-resisting rings, and thus the floating wear-resisting rings can play a role in good and long-term sealing between the kinetic plates.

4, In the present disclosure, scroll air exchange forms an internal air intake circulation, air enters from a middle to be compressed and then is discharged at a fixed plate sealing cavity whereas vacuumizing is reverse, a difference between the vacuum end and the compression end applied to VPSA oxygen generation is in compression volume, namely, heights of the scroll plates are different, the volume of the vacuum end is greater than the volume of the compression end, so a differential pressure is formed, and negative pressure desorption is formed in a VPSA oxygen generation process through a differential pressure principle.

Figure 1:
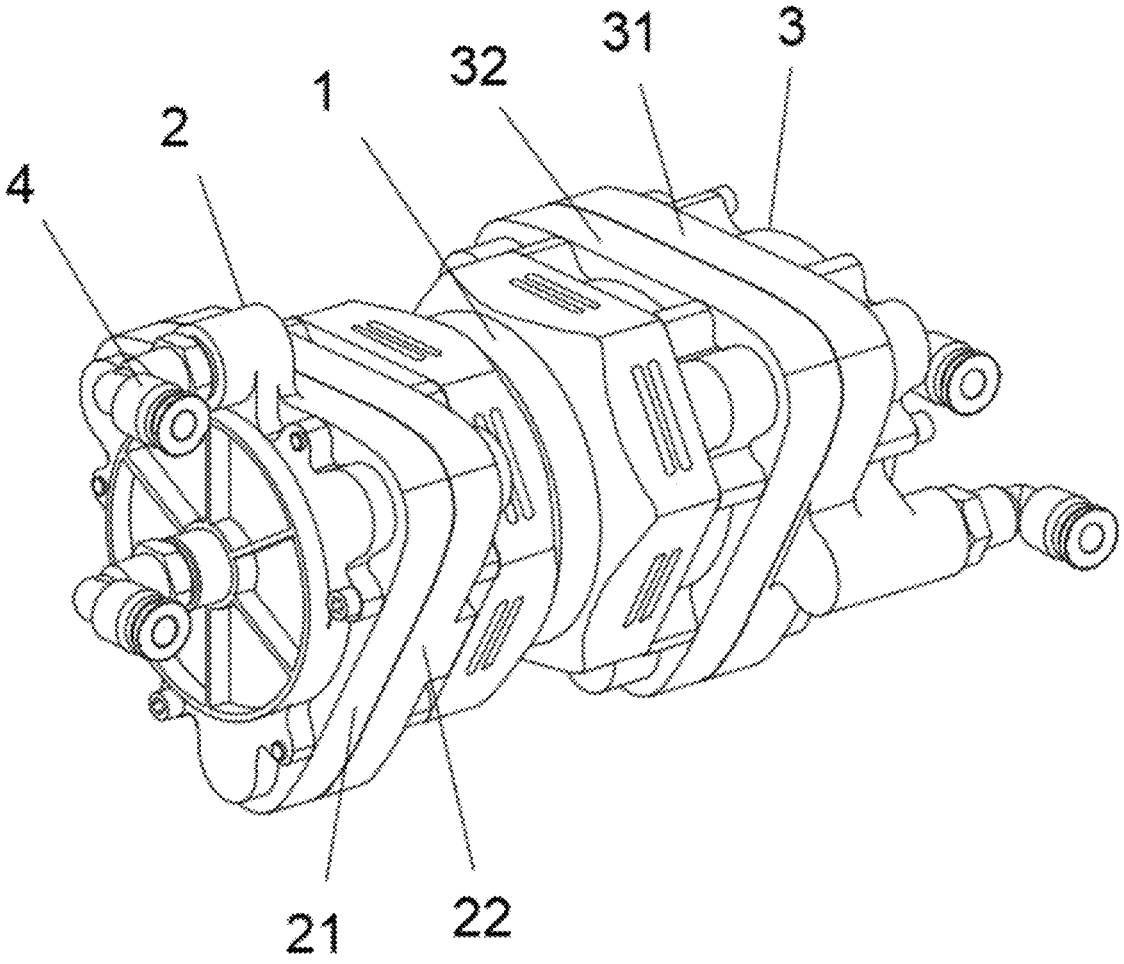
FIG. 1 is a space diagram of the present disclosure.

Reference numerals in the accompanying drawings include: 1, motor body, 11, square shaft, 12, heat dissipation shell, 13, heat-conducting counterweight wheel, 2, compression end, 21, first compression scroll fixed plate, 211, first compression scroll fixed plate scroll plate reserved drainage opening, 212, air inlet, 213, air outlet, 22, second compression scroll fixed plate, 221, second compression scroll fixed plate scroll plate reserved drainage opening, 23, first compression scroll kinetic plate, 24, second compression scroll kinetic plate, 241, compression scroll kinetic plate vent hole, 242, compression scroll kinetic plate floating wear-resisting ring mounting groove, 25, compression end eccentric group, 3, vacuum end, 31, first vacuum scroll fixed plate, 32, second vacuum scroll fixed plate, 33, first vacuum scroll kinetic plate, 34, second vacuum scroll kinetic plate, 341, vacuum scroll kinetic plate vent hole, 342, vacuum scroll kinetic plate floating wear-resisting ring mounting groove, 35, vacuum end eccentric group, 4, joint, 5, floating wear-resisting ring, 6, alignment bearing, 7, shaft eccentric inner ring, 8, seal ring, and 9, circular spring.

DETAILED DESCRIPTION OF THE INVENTION

The technical solutions in embodiments of the present disclosure are clearly and completely described in the following with reference to the accompanying drawings in the embodiments of the present disclosure. Apparently, the described embodiments are merely some rather than all of the embodiments of the present disclosure. All other embodiments obtained by those ordinarily skilled in the art based on the embodiments of the present disclosure without making creative efforts fall within the protection scope of the present disclosure.

Referring to FIG. 1 to FIG. 20, a floating-type oil-free vacuum scroll compressor includes a motor body 1, a compression end 2, a vacuum end 3 and a joint 4, wherein the compression end 2 and the vacuum end 3 are assembled at two ends of the motor body 1 respectively.

The motor body 1 is of a power structure and is configured to drive kinetic plates in the compression end 2 and the vacuum end 3 to move.

The compression end 2 includes a first compression scroll fixed plate 21, a second compression scroll fixed plate 22, a first compression scroll kinetic plate 23 and a second compression scroll kinetic plate 24, the first compression scroll kinetic plate 23 and the second compression scroll kinetic plate 24 are located inside the first compression scroll fixed plate 21 and the second compression scroll fixed plate 22, and the first compression scroll kinetic plate 23 and the second compression scroll kinetic plate 24 are assembled at an output end of one side of the motor body 1.

The vacuum end 3 includes a first vacuum scroll fixed plate 31, a second vacuum scroll fixed plate 32, a first vacuum scroll kinetic plate 33 and a second vacuum scroll kinetic plate 34, the first vacuum scroll kinetic plate 33 and the second vacuum scroll kinetic plate 34 are located inside the first vacuum scroll fixed plate 31 and the second vacuum scroll fixed plate 32, and the first vacuum scroll kinetic plate 33 and the second vacuum scroll kinetic plate 34 are assembled at an output end of the other side of the motor body 1.

The compression end 2 and the vacuum end 3 each change one conventional fixed plate structure into two, two kinetic plates matching the two fixed plates respectively are arranged inside, an air volume of air vacuumizing and compression is improved under the equivalent volume, multistage sealing is formed, a service life of a whole machine is prolonged, the working efficiency is improved, meanwhile, uniqueness matching of the kinetic plates and the fixed plates does not need to be performed by using this structural form, and components are universal.

Floating wear-resisting rings 5 are assembled between the first compression scroll kinetic plate 23 and the second compression scroll kinetic plate 24 and between the first vacuum scroll kinetic plate 33 and the second vacuum scroll kinetic plate 34, and circular springs 9 are assembled inside the floating wear-resisting rings 5.

Figure 7:
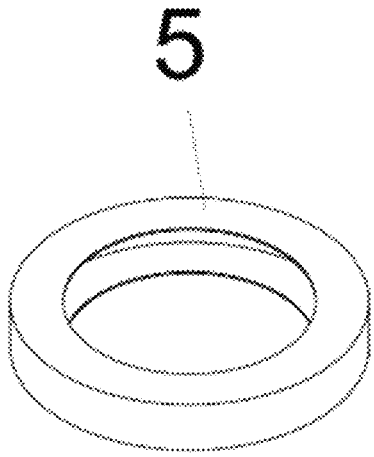
FIG. 7 is a structural diagram of a floating wear-resisting ring of the present disclosure.
Figure 21:
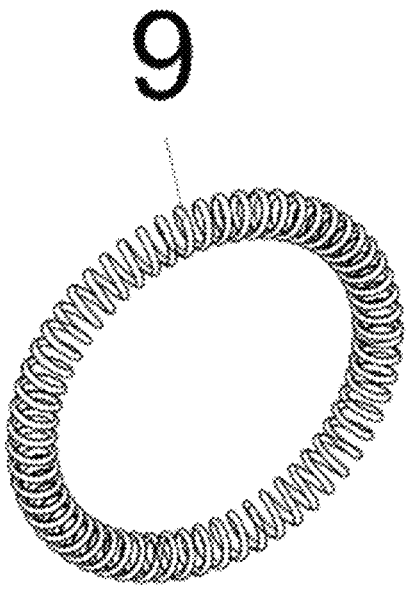
FIG. 21 is a structural diagram of a circular spring of the present disclosure.

As shown in FIG. 7 and FIG. 21, each circular spring 9 is a round spring that is compressible and deformable, during initial assembling, the circular spring 9 is obliquely arranged in the floating wear-resisting ring 5, and then a section of the circular spring 9 is made to form an elliptical shape.

A square shaft 11 which is arranged eccentrically is integrally formed at the output ends of the two sides of the motor body 1, an outer wall of the square shaft 11 is sleeved with shaft eccentric inner rings 7, alignment bearings 6 are assembled on outer walls of the shaft eccentric inner rings 7, the two alignment bearings 6 are respectively assembled inside inner holes of the first compression scroll kinetic plate 23 and the second compression scroll kinetic plate 24 and inside inner holes of the first vacuum scroll kinetic plate 33 and the second vacuum scroll kinetic plate 34.

By cooperation of the square shaft 11, the shaft eccentric inner rings 7 and the alignment bearings 6, the motor body 1, when running, can drive the kinetic plates in the compression end 2 and the vacuum end 3 to deflect, and thus a meshing part between each kinetic plate and fixed plate is made to form a scroll, so as to complete air compression.

The first compression scroll fixed plate 21, the second compression scroll fixed plate 22, the first compression scroll kinetic plate 23, the second compression scroll kinetic plate 24, the first vacuum scroll fixed plate 31, the second vacuum scroll fixed plate 32, the first vacuum scroll kinetic plate 33 and the second vacuum scroll kinetic plate 34 are made of a material of a mixture of PEEK mixed carbon fiber powder and polytetrafluoroethylene, and the floating wear-resisting rings 5 are made of a flexible material of a mixture of PEEK and polytetrafluoroethylene.

The material of the mixture of the PEEK mixed carbon fiber powder and polytetrafluoroethylene has a self-lubricating function.

When the self-lubricating function is achieved by the structure made of this material, micro-wear may occur with running, the kinetic plates are made to be in a micro planar sealing state, namely, the kinetic plates are allowed to have a certain gap range, so as to improve an assembling yield and reduce assembling requirement and difficulty, this characteristic reduces a friction coefficient between the fixed plates and the kinetic plates effectively, a minimum frictional loss after long-time running is achieved, the whole service life is prolonged, and a floating-type mounting manner is implemented.

Besides, with running, the certain gap range occurs to the kinetic plates, as the floating wear-resisting rings 5 are each of a flexible ring structure, the circular springs 9 may slowly change from an ellipse of mounting into a circle, so as to support the floating wear-resisting rings 5, and then the floating wear-resisting rings 5 play a role in long-term sealing between the two kinetic plates.

Figure 3:
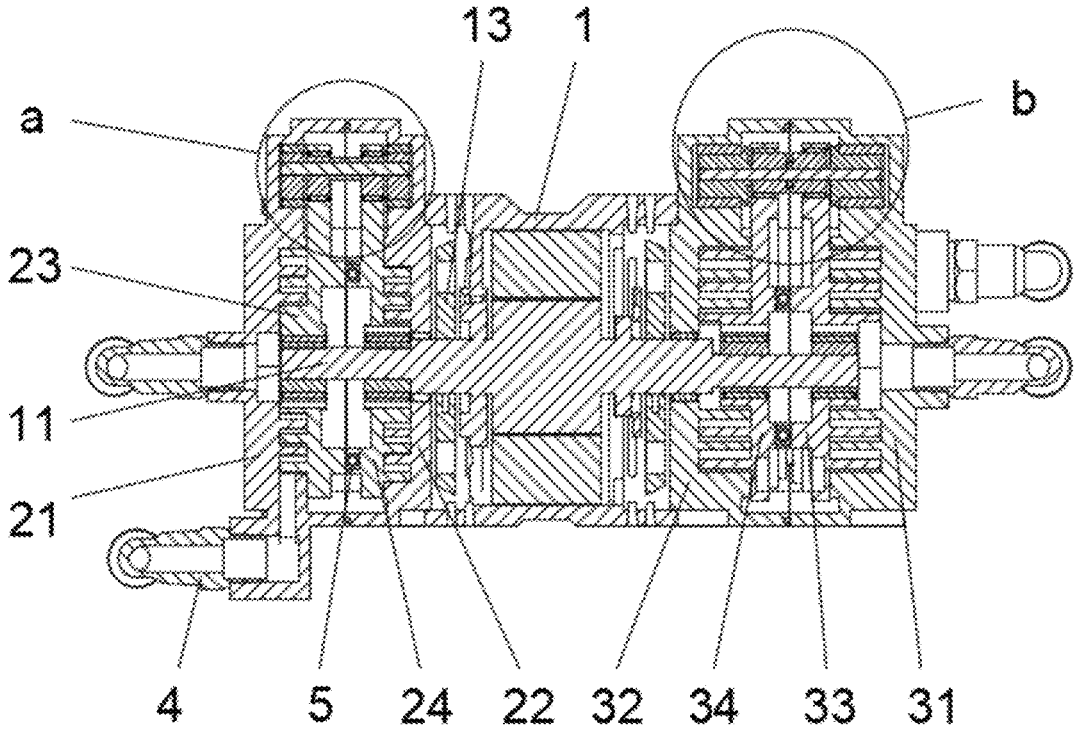
FIG. 3 is a front sectional view of the present disclosure.

Specifically, as shown in FIG. 3, volumes of the first vacuum scroll kinetic plate 33 and the second vacuum scroll kinetic plate 34 are greater than volumes of the first compression scroll kinetic plate 23 and the second compression scroll kinetic plate 24.

A volume of the vacuum end 3 is made to be greater than a volume of the compression end 2 to form a differential pressure, negative pressure desorption is formed through a differential pressure principle in a VPSA oxygen generation process.

A structure in the compression end 2 is approximately the same as a structure in the vacuum end 3, and the compression end and the vacuum end are different mainly in volume.

Figure 4:
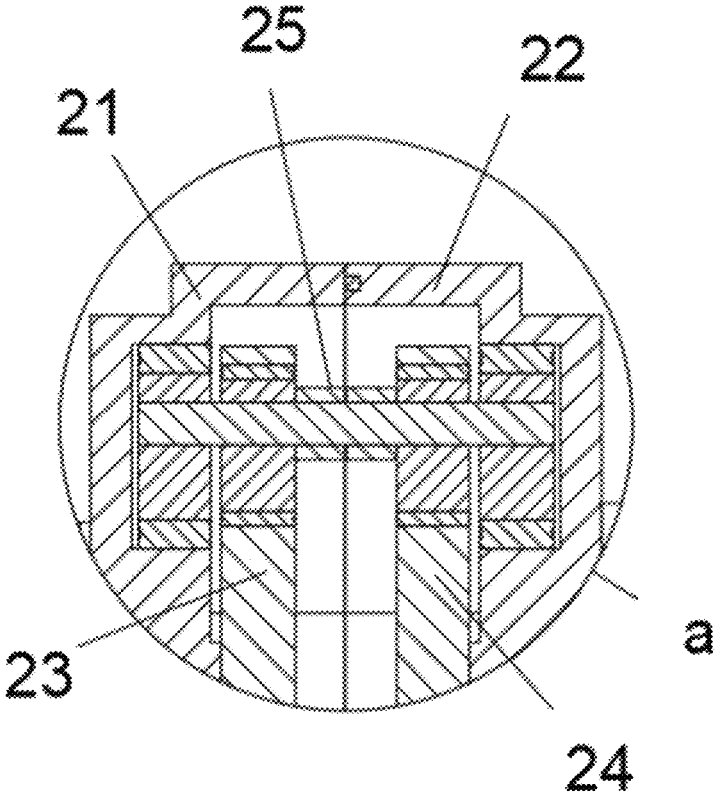
FIG. 4 is a partial enlarged view of a part a in FIG. 3 of the present disclosure.
Figure 5:
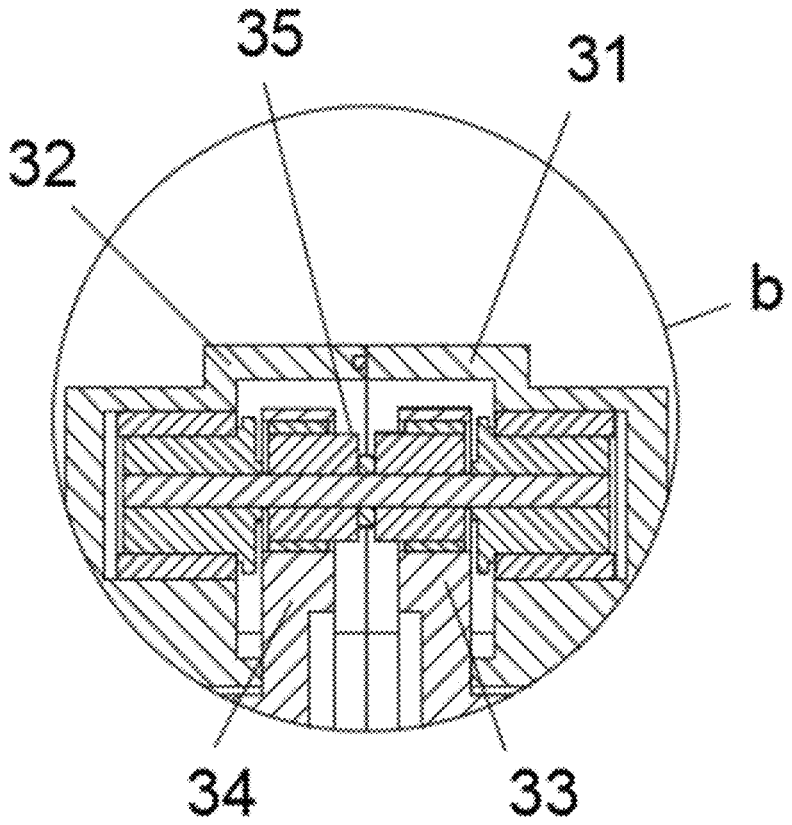
FIG. 5 is a partial enlarged view of a part b in FIG. 3 of the present disclosure.

Specifically, as shown in FIG. 4 and FIG. 5, a compression end eccentric group 25 is assembled between the first compression scroll fixed plate 21 and the second compression scroll fixed plate 22, the compression end eccentric group 25 includes an eccentric pin, four rotor eccentric wheels and four floating bearings, the four floating bearings are assembled on outer walls of the rotor eccentric wheels, the four rotor eccentric wheels are connected to an outer wall of the eccentric pin a sleeving mode, the two floating bearings on an outer side are assembled on outer sides of inner walls of the first compression scroll fixed plate 21 and the second compression scroll fixed plate 22 respectively, the two floating bearings on an inner side are assembled on outer sides of side walls of the first compression scroll kinetic plate 23 and the second compression scroll kinetic plate 24 respectively, and an eccentric gap of the eccentric pin is the same as an eccentric gap of the square shaft 11.

A vacuum end eccentric group 35 is assembled between the first vacuum scroll fixed plate 31 and the second vacuum scroll fixed plate 32, and a structure and an assembling manner of the vacuum end eccentric group 35 are the same as a structure and an assembling manner of the compression end eccentric group 25.

Figure 2:
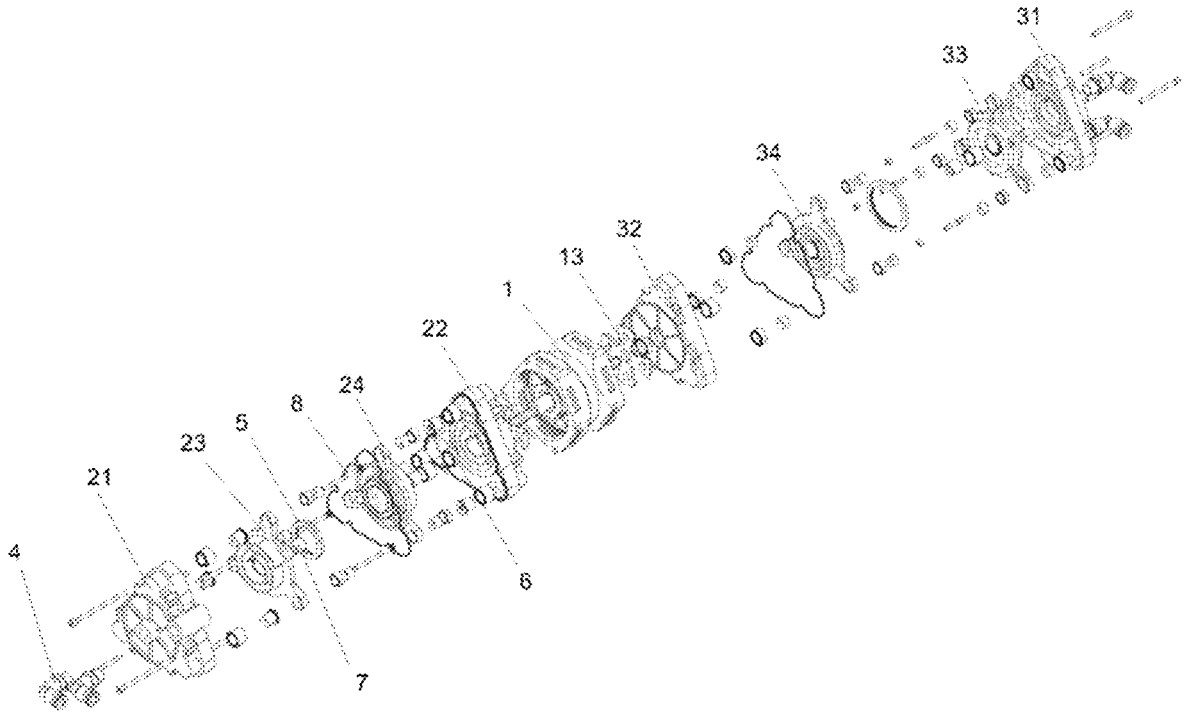
FIG. 2 is an explosive view of the present disclosure.

It may be known from FIG. 1 and FIG. 2 that three eccentric pin and bearing assembling points are arranged on an outer side of each kinetic plate and fixed plate.

Each eccentric pin has not only the same eccentric gap as the square shaft 11, but also the same deflection angle, so the kinetic plates are made to run within a fixed logic range.

Specifically, as shown in FIG. 9 to FIG. 12, a first compression scroll fixed plate scroll plate reserved drainage opening 211 and a second compression scroll fixed plate scroll plate reserved drainage opening 221 which communicate with outermost ends of the scroll plates are formed symmetrically in inner walls of the first compression scroll fixed plate 21 and the second compression scroll fixed plate 22, an air inlet 212 and an air outlet 213 are formed in an outer wall of the first compression scroll fixed plate 21, the air inlet 212 is located in a middle of the first compression scroll fixed plate 21, the air outlet 213 is located on a side of the first compression scroll fixed plate 21, and the air outlet 213 communicates with an outer end of the scroll plate of the first compression scroll fixed plate 21.

Figure 11:
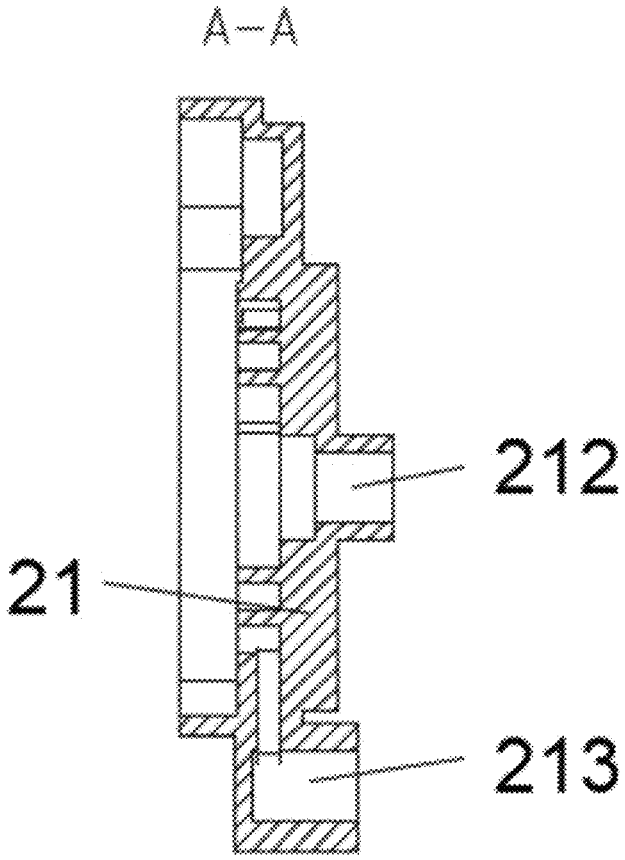
FIG. 11 is a sectional view of A-A in FIG. 10 of the present disclosure.
Figure 12:
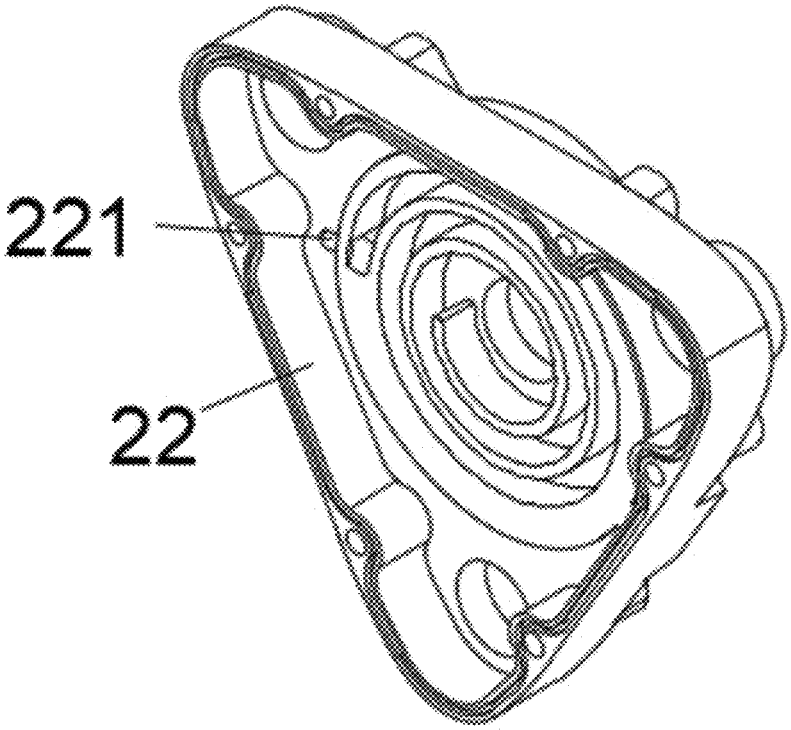
FIG. 12 is a space diagram of a second compression scroll fixed plate of the present disclosure.
Figure 13:
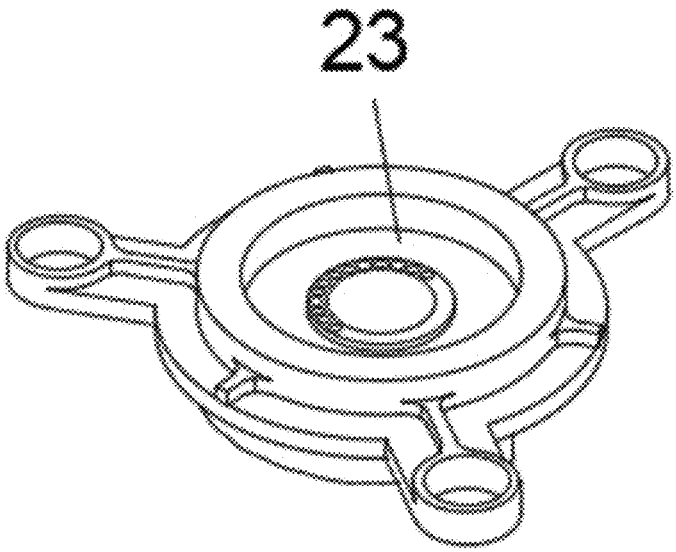
FIG. 13 is a first space diagram of a first compression scroll kinetic plate of the present disclosure.

As shown in FIG. 11, a hole communicating with the air outlet 213 is formed in a scroll groove of the scroll plate of the first compression scroll fixed plate 21.

During mounting, a surface of the scroll plate of the first compression scroll fixed plate 21 is attached to a surface of the scroll plate of the second compression scroll fixed plate 22, so air compressed by the first compression scroll fixed plate 21 and the second compression scroll fixed plate 22 communicate with the first compression scroll fixed plate scroll plate reserved drainage opening 211 and the second compression scroll fixed plate scroll plate reserved drainage opening 221, and thus the compressed air is made to finally reach the air outlet 213 to be discharged.

Structures of the first vacuum scroll fixed plate 31 and the second vacuum scroll fixed plate 32 are the same as structures of the first compression scroll fixed plate 21 and the second compression scroll fixed plate 22.

Specifically, as shown in FIG. 13 to FIG. 16, compression scroll kinetic plate vent holes 241 are formed in inner sides of surfaces of the first compression scroll kinetic plate 23 and the second compression scroll kinetic plate 24, the plurality of compression scroll kinetic plate vent holes 241 have the same diameter and are distributed annularly, and compression scroll kinetic plate floating wear-resisting ring mounting grooves 242 are formed in an inner wall of the second compression scroll kinetic plate 24.

Figure 14:
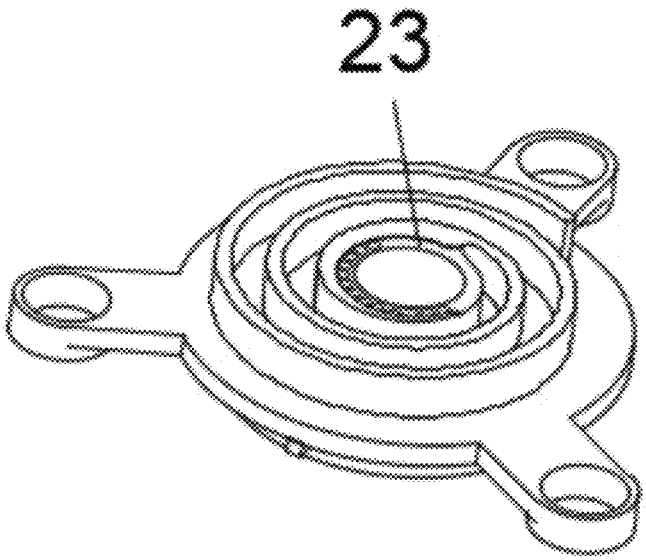
FIG. 14 is a second space diagram of a first compression scroll kinetic plate of the present disclosure.
Figure 15:
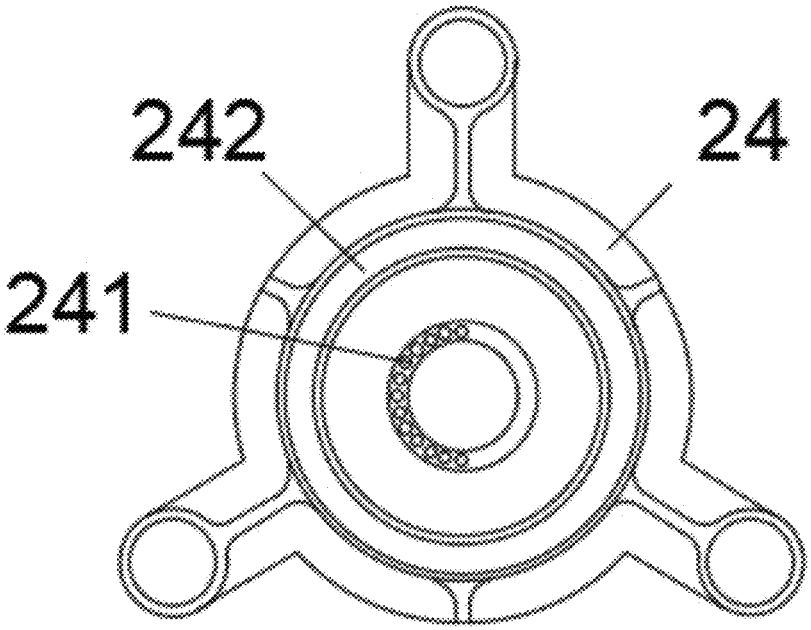
FIG. 15 is a front view of a second compression scroll kinetic plate of the present disclosure.
Figure 16:
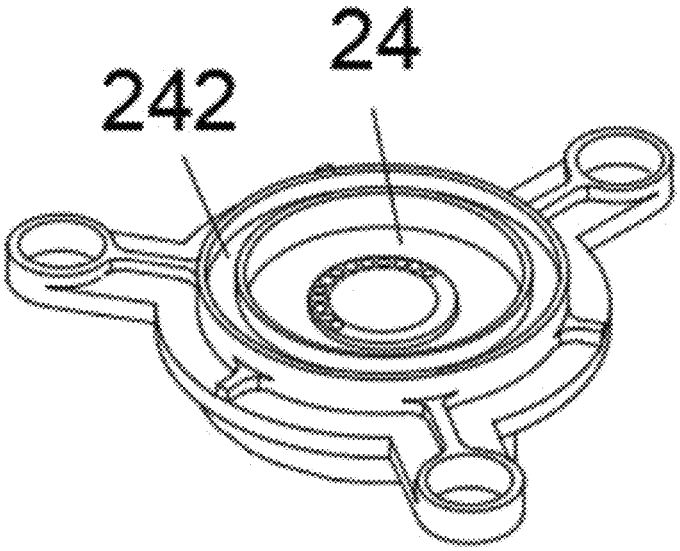
FIG. 16 is a space diagram of a second compression scroll kinetic plate of the present disclosure.
Figure 17:
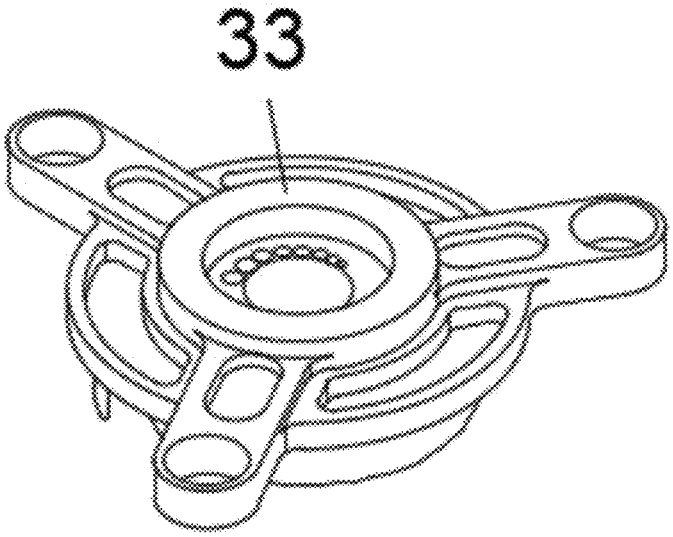
FIG. 17 is a first space diagram of a first vacuum scroll kinetic plate of the present disclosure.

As shown in FIG. 14, a groove is formed in an inner ring of a surface of a scroll plate of the first compression scroll kinetic plate 23, the compression scroll kinetic plate vent holes 241 are made to communicate with the air inlet 212, so incoming air can directly enter a meshing space between the first compression scroll kinetic plate 23 and the first compression scroll fixed plate 21, and likewise, a groove is also formed in an inner ring of a surface of a scroll plate of the second compression scroll kinetic plate 24.

Due to mounting of the square shaft 11, the alignment bearings 6 and the shaft eccentric inner rings 7, a part of air entering from the air inlet 212 is compressed in the meshing space between the first compression scroll kinetic plate 23 and the first compression scroll fixed plate 21, and the other part of air enters a meshing space between the second compression scroll kinetic plate 24 and the second compression scroll fixed plate 22 through the compression scroll kinetic plate vent holes 241 to be compressed.

Specifically, as shown in FIG. 17 to FIG. 20, vacuum scroll kinetic plate vent holes 341 are formed in inner sides of surfaces of the first vacuum scroll kinetic plate 33 and the second vacuum scroll kinetic plate 34, diameters of the plurality of vacuum scroll kinetic plate vent holes 341 which are distributed annularly are reduced in sequence, and vacuum scroll kinetic plate floating wear-resisting ring mounting grooves 342 are formed in an inner wall of the second vacuum scroll kinetic plate 34.

Figure 18:
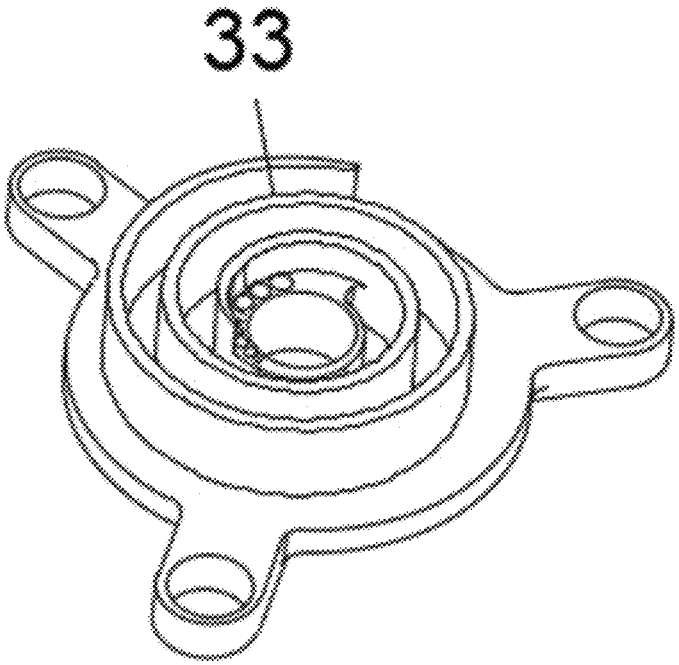
FIG. 18 is a second space diagram of a first vacuum scroll kinetic plate of the present disclosure.
Figure 19:
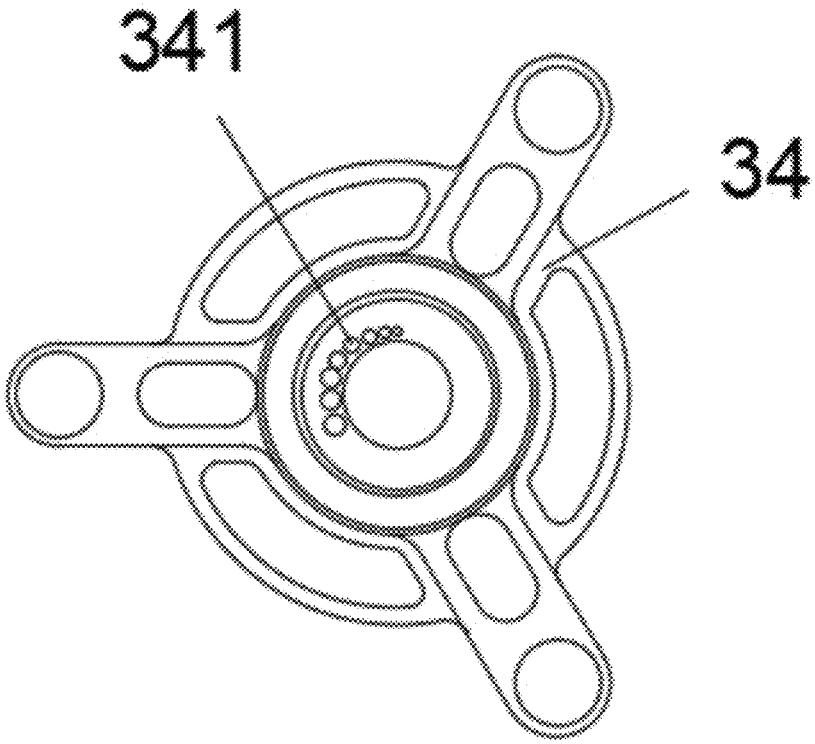
FIG. 19 is a front view of a second vacuum scroll kinetic plate of the present disclosure.
Figure 20:
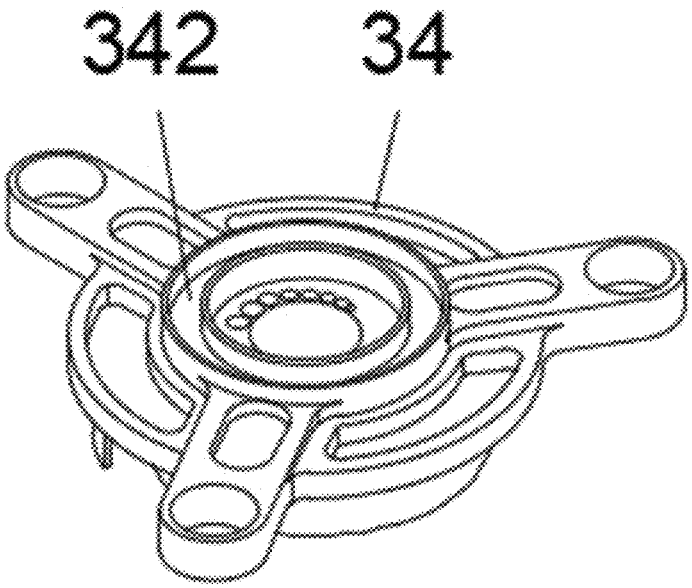
FIG. 20 is a space diagram of a second vacuum scroll kinetic plate of the present disclosure.

As shown in FIG. 18, a groove is formed in an inner ring of a surface of a scroll plate of the first vacuum scroll kinetic plate 33, the vacuum scroll kinetic plate vent holes 341 are made to communicate with the air inlet 212 in the first vacuum scroll fixed plate 31, so incoming air can directly enter a meshing space between the first vacuum scroll kinetic plate 33 and the first vacuum scroll fixed plate 31, and likewise, a groove is also formed in an inner ring of a surface of a scroll plate of the second vacuum scroll kinetic plate 34.

Therefore, air entering the vacuum end 3 is compressed in the meshing space between the first vacuum scroll kinetic plate 33 and the first vacuum scroll fixed plate 31 and in a meshing space between the second vacuum scroll kinetic plate 34 and the second vacuum scroll fixed plate 32 respectively under an action of the groove and the vacuum scroll kinetic plate vent holes 341.

Besides, shapes of the compression scroll kinetic plate vent holes 241 and the vacuum scroll kinetic plate vent holes 341 are designed, and an objective of making the compression scroll kinetic plate vent holes 241 have the same diameter and be distributed annularly is to improve stability of a positive pressure through the compression scroll kinetic plate vent holes 241 and a double-kinetic-plate air passing seal part, and the positive pressure is emphasized.

An objective of making the diameters of the vacuum scroll kinetic plate vent holes 341 which are distributed annularly be reduced in sequence is to improve a negative-pressure discharging efficiency through the vacuum scroll kinetic plate vent holes 341 and a double-kinetic-plate air passing seal part, and a negative pressure is emphasized.

Figure 6:
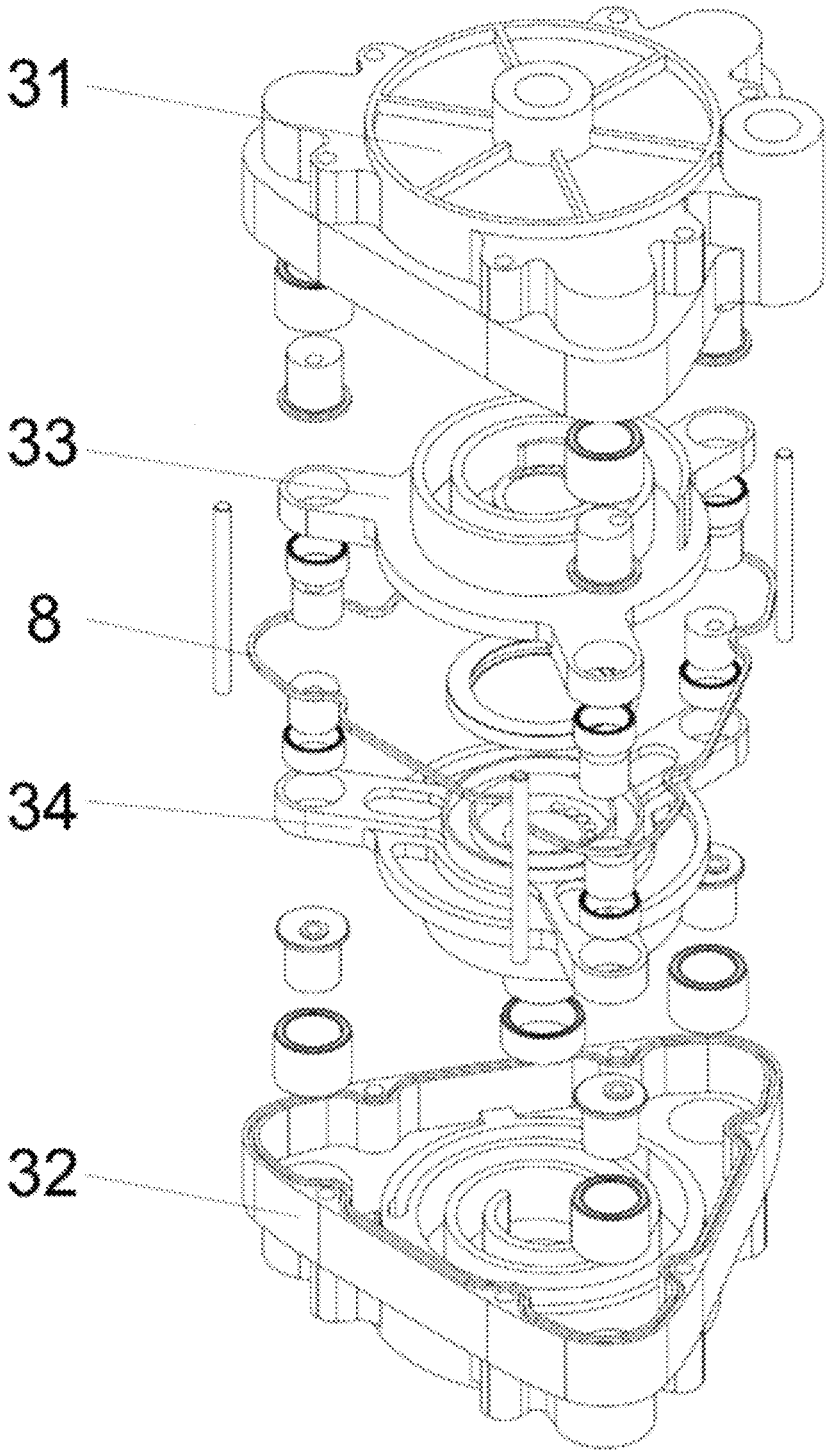
FIG. 6 is an explosive view of a vacuum end pf the present disclosure.

Specifically, as shown in FIG. 2 and FIG. 6, seal grooves are formed in peripheries of inner walls of the second compression scroll fixed plate 22 and the second vacuum scroll fixed plate 32, and seal rings 8 are assembled in the seal grooves.

Figure 8:
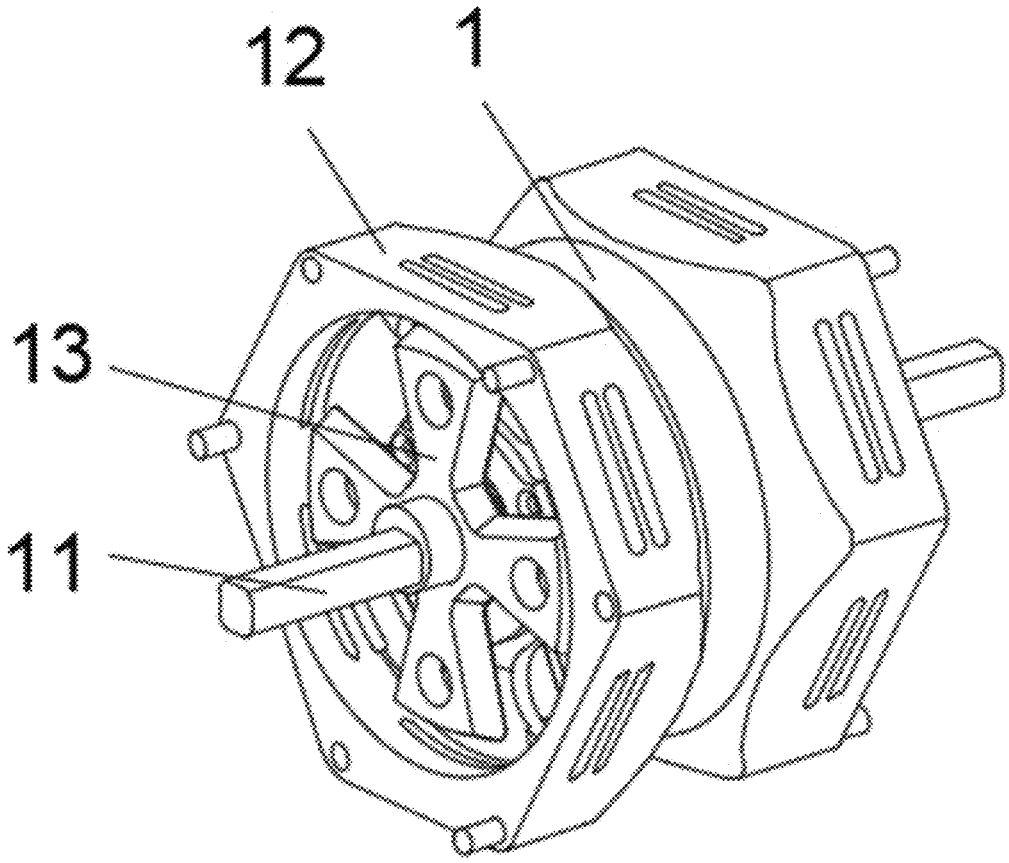
FIG. 8 is a space diagram of a motor body of the present disclosure.
Figure 9:
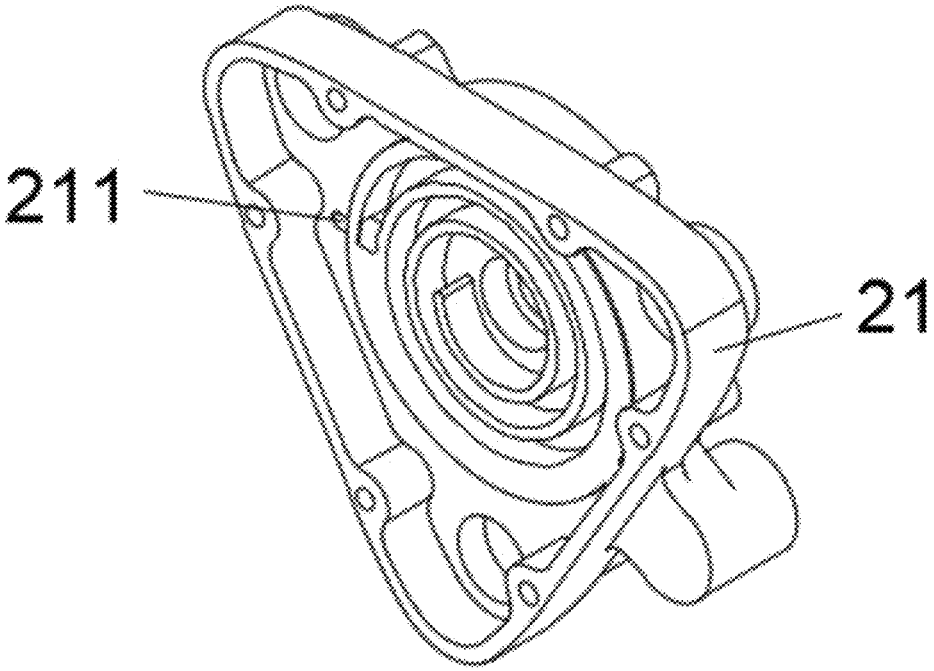
FIG. 9 is a space diagram of a first compression scroll fixed plate of the present disclosure.
Figure 10:
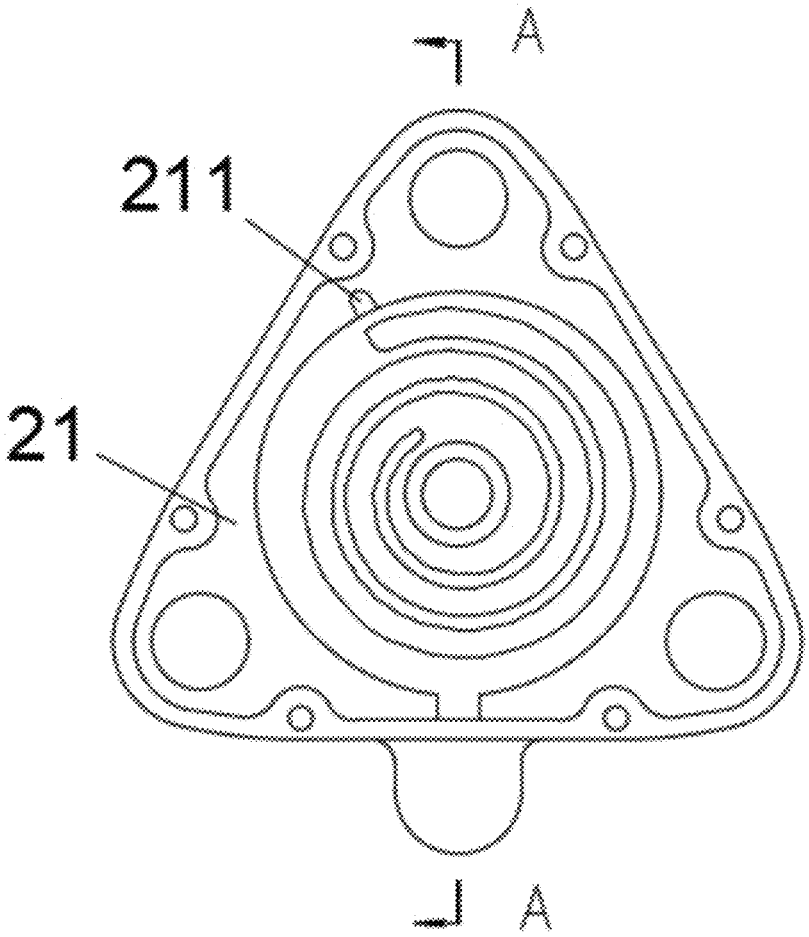
FIG. 10 is a front view of a first compression scroll fixed plate of the present disclosure.

Specifically, as shown in FIG. 8, heat dissipation shells 12 are integrally formed in two ends of the motor body 1, heat dissipation holes are formed in side walls of the heat dissipation shells 12, heat-conducting counterweight wheels 13 located inside the heat dissipation shells 12 are fixedly mounted on an outer wall of an output end of the motor body 1, and the second compression scroll fixed plate 22 and the second vacuum scroll fixed plate 32 are fixedly mounted on outer ends of the heat dissipation shells 12 respectively.

The heat-conducting counterweight wheels 13 play a role in enhancing rotary force of a motor shaft and dynamic balance and dissipating heat of a motor, and the heat is dissipated mainly from the heat dissipation holes in the heat dissipation shells 12.

The above content is only preferred embodiments of the present disclosure, those ordinarily skilled in the art may make many changes to specific implementations and application scope according to the concept of the present disclosure, and these changes fall within the protection scope of the present disclosure as long as these changes do not depart from the concept of the present disclosure.

The invention claimed is:

1. A floating-type oil-free vacuum scroll compressor, comprising a motor body, a compression end, a vacuum end and a joint, wherein the compression end and the vacuum end are assembled at two ends of the motor body respectively;

the compression end comprises a first compression scroll fixed plate, a second compression scroll fixed plate, a first compression scroll kinetic plate and a second compression scroll kinetic plate, the first compression scroll kinetic plate and the second compression scroll kinetic plate are located inside the first compression scroll fixed plate and the second compression scroll fixed plate, and the first compression scroll kinetic plate and the second compression scroll kinetic plate are assembled at an output end of one side of the motor body;

the vacuum end comprises a first vacuum scroll fixed plate, a second vacuum scroll fixed plate, a first vacuum scroll kinetic plate and a second vacuum scroll kinetic plate, the first vacuum scroll kinetic plate and the second vacuum scroll kinetic plate are located inside the first vacuum scroll fixed plate and the second vacuum scroll fixed plate, and the first vacuum scroll kinetic plate and the second vacuum scroll kinetic plate are assembled at an output end of the other side of the motor body;

floating wear-resisting rings are assembled between the first compression scroll kinetic plate and the second compression scroll kinetic plate and between the first vacuum scroll kinetic plate and the second vacuum scroll kinetic plate, and circular springs are assembled inside the floating wear-resisting rings;

a square shaft which is arranged eccentrically is integrally formed at the output ends of the two sides of the motor body, an outer wall of the square shaft is sleeved with shaft eccentric inner rings, alignment bearings are assembled on outer walls of the shaft eccentric inner rings, and the two alignment bearings are respectively assembled inside inner holes of the first compression scroll kinetic plate and the second compression scroll kinetic plate and inside inner holes of the first vacuum scroll kinetic plate and the second vacuum scroll kinetic plate;

the first compression scroll fixed plate, the second compression scroll fixed plate, the first compression scroll kinetic plate, the second compression scroll kinetic plate, the first vacuum scroll fixed plate, the second vacuum scroll fixed plate, the first vacuum scroll kinetic plate and the second vacuum scroll kinetic plate are made of a material of a mixture of PEEK mixed carbon fiber powder and polytetrafluoroethylene, and the floating wear-resisting rings are made of a flexible material of a mixture of PEEK and polytetrafluoroethylene; and volumes of the first vacuum scroll kinetic plate and the second vacuum scroll kinetic plate are greater than volumes of the first compression scroll kinetic plate and the second compression scroll kinetic plate.

2. The floating-type oil-free vacuum scroll compressor according to claim 1, wherein a compression end eccentric group is assembled between the first compression scroll fixed plate and the second compression scroll fixed plate, the compression end eccentric group comprises an eccentric pin, four rotor eccentric wheels and four floating bearings, the four floating bearings are assembled on outer walls of the rotor eccentric wheels, the four rotor eccentric wheels are connected to an outer wall of the eccentric pin a sleeving mode, the two floating bearings on an outer side are assembled on outer sides of inner walls of the first compression scroll fixed plate and the second compression scroll fixed plate respectively, the two floating bearings on an inner side are assembled on outer sides of side walls of the first compression scroll kinetic plate and the second compression scroll kinetic plate respectively, and an eccentric gap of the eccentric pin is the same as an eccentric gap of the square shaft; and a vacuum end eccentric group is assembled between the first vacuum scroll fixed plate and the second vacuum scroll fixed plate, and a structure and an assembling manner of the vacuum end eccentric group are the same as a structure and an assembling manner of the compression end eccentric group.

3. The floating-type oil-free vacuum scroll compressor according to claim 1, wherein a first compression scroll fixed plate scroll plate reserved drainage opening and a second compression scroll fixed plate scroll plate reserved drainage opening which communicate with outermost ends of the scroll plates are formed symmetrically in inner walls of the first compression scroll fixed plate and the second compression scroll fixed plate, an air inlet and an air outlet are formed in an outer wall of the first compression scroll fixed plate, the air inlet is located in a middle of the first compression scroll fixed plate, the air outlet is located on a side of the first compression scroll fixed plate, and the air outlet communicates with an outer end of the scroll plate of the first compression scroll fixed plate; and structures of the first vacuum scroll fixed plate and the second vacuum scroll fixed plate are the same as structures of the first compression scroll fixed plate and the second compression scroll fixed plate.

4. The floating-type oil-free vacuum scroll compressor according to claim 1, wherein compression scroll kinetic plate vent holes are formed in inner sides of surfaces of the first compression scroll kinetic plate and the second compression scroll kinetic plate, the plurality of compression scroll kinetic plate vent holes have the same diameter and are distributed annularly, and compression scroll kinetic plate floating wear-resisting ring mounting grooves are formed in an inner wall of the second compression scroll kinetic plate.

5. The floating-type oil-free vacuum scroll compressor according to claim 1, wherein vacuum scroll kinetic plate vent holes are formed in inner sides of surfaces of the first vacuum scroll kinetic plate and the second vacuum scroll kinetic plate, diameters of the plurality of vacuum scroll kinetic plate vent holes which are distributed annularly are reduced in sequence, and vacuum scroll kinetic plate floating wear-resisting ring mounting grooves are formed in an inner wall of the second vacuum scroll kinetic plate.

6. The floating-type oil-free vacuum scroll compressor according to claim 1, wherein seal grooves are formed in peripheries of inner walls of the second compression scroll fixed plate and the second vacuum scroll fixed plate, and seal rings are assembled in the seal grooves.

7. The floating-type oil-free vacuum scroll compressor according to claim 1, wherein heat dissipation shells are integrally formed in two ends of the motor body, heat dissipation holes are formed in side walls of the heat dissipation shells, heat-conducting counterweight wheels located inside the heat dissipation shells are fixedly mounted on an outer wall of an output end of the motor body, and the second compression scroll fixed plate and the second vacuum scroll fixed plate are fixedly mounted on outer ends of the heat dissipation shells respectively.

* * * * *